US009413049B2

(12) United States Patent
Wootan et al.

(10) Patent No.: US 9,413,049 B2
(45) Date of Patent: Aug. 9, 2016

(54) ROTARY JOINT INCLUDING FIRST AND SECOND ANNULAR PARTS DEFINING ANNULAR WAVEGUIDES CONFIGURED TO ROTATE ABOUT AN AXIS OF ROTATION

(71) Applicant: Raytheon Company, Waltham, MA (US)

(72) Inventors: John J Wootan, Hermosa Beach, CA (US); Clifton Quan, Arcadia, CA (US); Chad E Patterson, Marina Del Ray, CA (US); Michael D Runyan, Torrance, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/223,028

(22) Filed: Mar. 24, 2014

(65) Prior Publication Data

US 2015/0270671 A1 Sep. 24, 2015

(51) Int. Cl.
*H01P 1/06* (2006.01)
*H01R 39/08* (2006.01)

(52) U.S. Cl.
CPC ..... *H01P 1/068* (2013.01); *H01P 1/067* (2013.01); *H01R 39/08* (2013.01)

(58) Field of Classification Search
CPC ..... H01P 1/06; H01P 1/062; H01P 1/065; H01P 1/066; H01P 1/068; H01P 1/069
USPC ..... 333/256, 257, 261
See application file for complete search history.

(56) References Cited

U.S. PATENT DOCUMENTS 3,099,807 A 7/1963 Oh
3,199,055 A * 8/1965 Keen ..... 333/263
3,426,309 A 2/1969 Goodman, Jr.
(Continued)

FOREIGN PATENT DOCUMENTS

FR 2984612 A1 6/2013
GB 1112402 A 5/1968
(Continued)

OTHER PUBLICATIONS

International Search Report and Written Opinion for corresponding application No. PCT/US2015/021746 mailed Jul. 3, 2015.

*Primary Examiner* — Benny Lee
(74) *Attorney, Agent, or Firm* — Renner, Otto, Boisselle & Sklar, LLP

(57) ABSTRACT

A rotary joint includes a contactless electrical connection that has an annular shape, not extending into a central region surrounded and defined by the annular contactless electrical connection. The annular shape of the electrical connection portions allows other uses for the central region, such as for passing an optical signal through the rotary joint. Feeds are coupled to annular waveguide structures in both halves of the rotary joint, for input and output of signals. The feeds may provide connections to the annular waveguide structures at regularly-spaced circumferential intervals around the waveguide structures, such as at about every half-wavelength of the incoming (and outgoing) signals. The annular waveguide structures propagate signals in an axial direction, parallel to the axis of rotation of the rotary joint. The signals propagate contactlessly (non-electrically-conductively) across a gap in the axial direction between the two annular waveguides.

14 Claims, 8 Drawing Sheets

(56) References Cited

U.S. PATENT DOCUMENTS

| | | | | | |
|---|---|---|---|---|---|
| 3,914,715 | A | | 10/1975 | Hubing et al. | |
| 4,103,262 | A | * | 7/1978 | Woodward | 333/136 |
| 4,117,426 | A | * | 9/1978 | Hudspeth et al. | 333/257 |
| 4,258,365 | A | | 3/1981 | Hockham et al. | |
| 4,427,983 | A | | 1/1984 | Kruger et al. | |
| 4,511,868 | A | | 4/1985 | Munson et al. | |
| 4,516,097 | A | | 5/1985 | Munson et al. | |
| 5,140,289 | A | * | 8/1992 | Andrieu et al. | 333/256 |
| 5,233,320 | A | | 8/1993 | Evans | |

FOREIGN PATENT DOCUMENTS

| | | | |
|---|---|---|---|
| GB | 2077514 | A | 12/1981 |
| WO | 20120041554 | A1 | 4/2012 |

* cited by examiner

ROTARY JOINT INCLUDING FIRST AND SECOND ANNULAR PARTS DEFINING ANNULAR WAVEGUIDES CONFIGURED TO ROTATE ABOUT AN AXIS OF ROTATION

FIELD OF THE INVENTION

The invention is in the field of rotary electrical connections.

DESCRIPTION OF THE RELATED ART

Traditional slip rings are electromechanical technology that enables the transmission of power and electrical signals from a stationary to a rotating structure. This transmission of power/data is made possible through electrical contact connections made by such devices as stationary brushes, cylindrical pins, or a sphere pressing against rotating circular conductors. This pressure electrical contact has reliability and wear issues in use. Contactless rotary joints also exist through capacitive and inductive coupling or by fiber optic signal transmission. Traditional rotary joints, like these, utilize rotational symmetry about the center axis and require the input, output ports and critical signal path be placed at the center axis of rotation to maintain constant phase and amplitude transmission independent of rotation. It would be advantageous to have rotary electrical contacts that avoid these shortcomings.

SUMMARY OF THE INVENTION

A rotary joint includes a contactless annular electrical connection.

According to an aspect of the invention, a rotary joint includes: a first part; and a second part that rotates relative to the first part about an axis of rotation. The first part has a first electrical connection annular portion. The second part has a second electrical connection annular portion. The electrical connection annular portions make contactless electrical connection with one another. The electrical connection annular portions together define and surround a core region, in which an electrical connection between the electrical connection annular portions is not made. The core region includes the axis of rotation.

According to another aspect of the invention, a method of passing an electrical signal across a rotary joint includes the steps of: inputting an incoming electrical signal into a first feed that splits the signal; generating in the first feed a transverse electromagnetic (TEM) wave, wherein the TEM wave propagates in an axial direction through a first annular waveguide structure that is coupled to the first feed; passing the TEM wave across an axial gap, from the first annular waveguide structure to a second annular waveguide structure that is able to rotate relative to the first annular waveguide structure about an axis of rotation of the rotary joint that does not pass through the annular waveguide structures; and generating an outgoing electrical signal from the TEM wave in a second feed that is operatively coupled to the second annular waveguide structure.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A rotary joint includes a contactless electrical connection that has an annular shape, not extending into a central region surrounded and defined by the annular contactless electrical connection. The annular shape of the electrical connection portions allows other uses for the central region, such as for passing an optical signal through the rotary joint. Feeds are coupled to annular waveguide structures in both halves of the rotary joint, for input and output of signals. The feeds may provide connections to the annular waveguide structures at regularly-spaced circumferential intervals around the waveguide structures. The intervals may be at about every half-wavelength of the incoming (and outgoing) signals, or may be at any of a variety of other suitable spacing. The annular waveguide structures propagate signals in an axial direction, parallel to the axis of rotation of the rotary joint. The signals propagate contactlessly (non-electrically-conductively) across a gap in the axial direction between the two annular waveguides.

Figure 1:
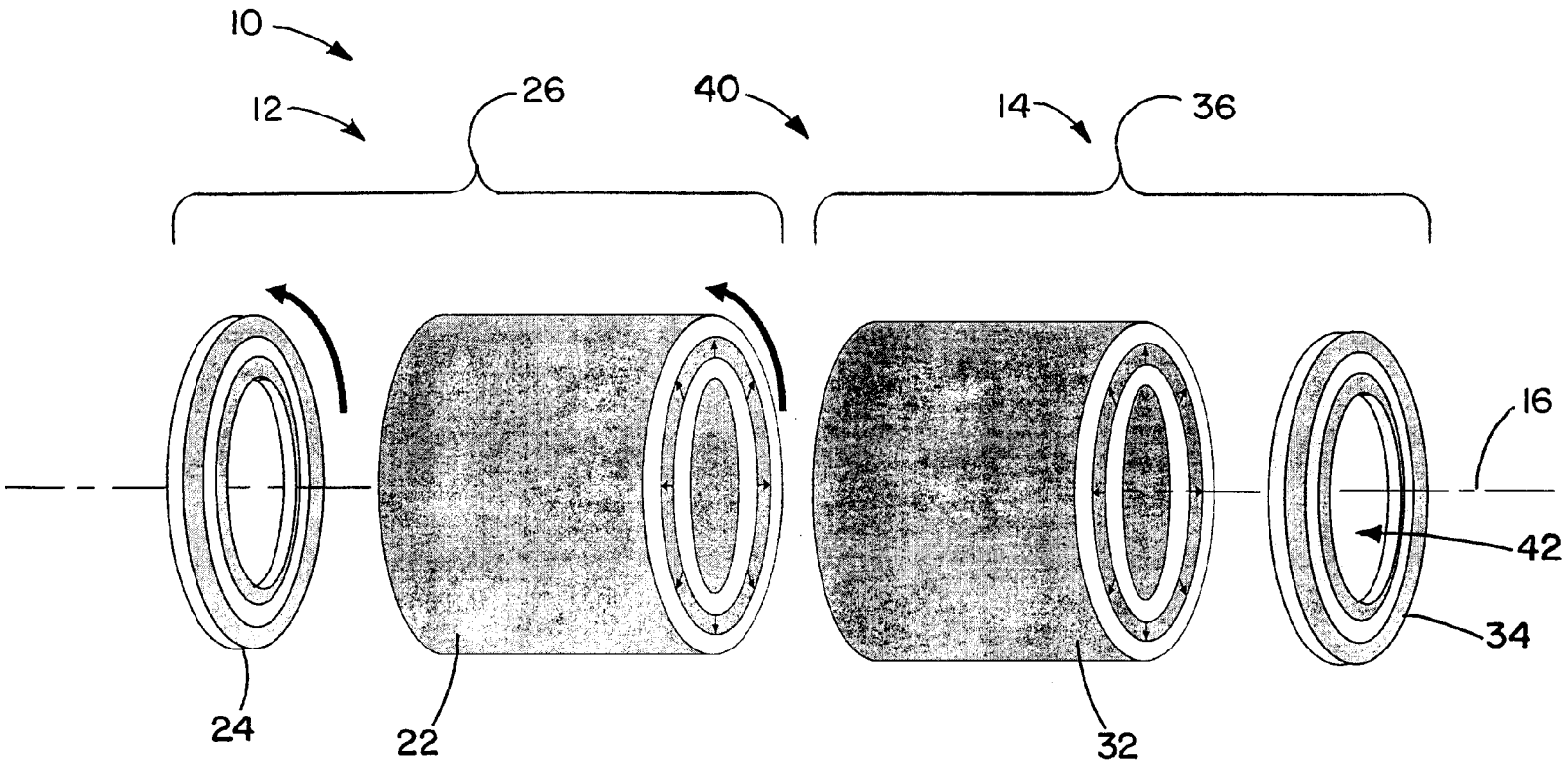
FIG. 1 is a schematic view of parts of a rotary joint in accordance with an embodiment of the invention.

FIG. 1 shows some parts of a rotary joint 10 that includes a first part 12 that rotates relative to a second part 14, about an axis of rotation 16 of the rotary joint 10. The parts 12 and 14 include respective annular waveguide structures 22 and 32, and respective feeds 24 and 34. The feeds 24 and 34 are used for feeding signals to and receiving signals from the waveguide structures 22 and 32. The annular waveguide structure 22 and the feed 24 together make a first electrical connection annular portion 26, and the annular waveguide structure 32 and the feed 34 together make a second electrical connection annular portion 36. The electrical connection portions 26 and 36 together constitute an electrical connection 40 that is part of the rotary joint 10. As described in greater detail below, the structure of the electrical connection 40 sets up a transverse electromagnetic (TEM) wave that propagates in the axial direction, being able to propagate across a gap between the annular waveguide structures 22 and 32. The electrical connection between the portions 26 and 36 is therefore contactless in that the primary way that electrical signals are transferred from the parts 12 and 14 is not through electrical conduction by contact of electrically-conducting materials of the two parts 12 and 14.

The electrical connection 40 is annular in shape, with the annular portions 26 and 36 together defining and surrounding a core region 42, in which an electrical connection between the annular portions 26 and 36 is not made. The core region 42 includes the axis of rotation 16.

The parts 12 and 14 may include additional components that are not related to the electrical connection 40. For example, the parts 12 and 14 may include parts of casings, or other components.

Figure 2:
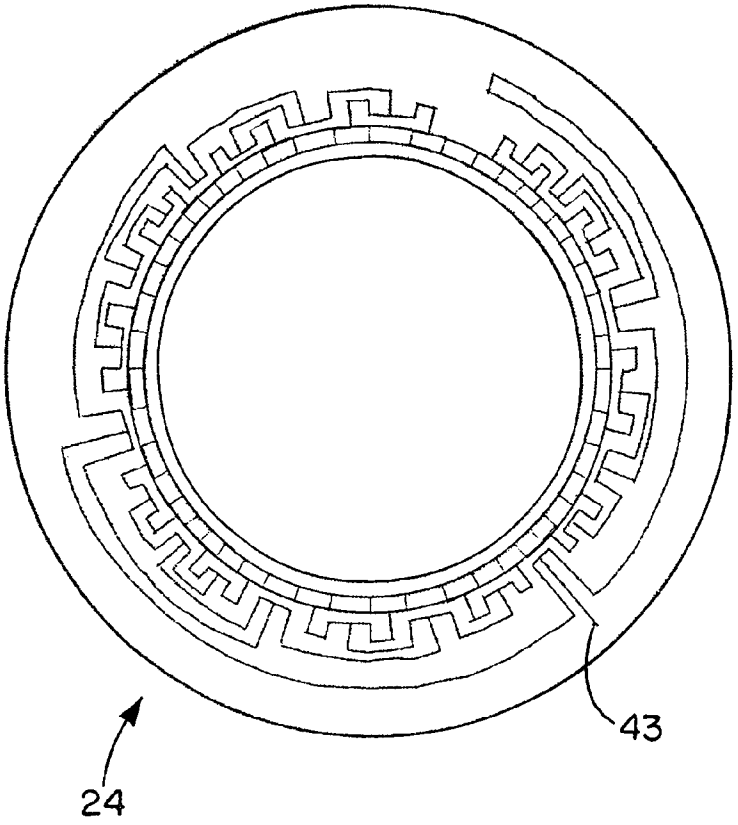
FIG. 2 is a plan view showing a layout of one of the feeds of the rotary joint of FIG. 1.

FIG. 2 shows the layout for the feed 24. The feed 34 (not shown in FIG. 2) has a similar layout, and both of the feeds 24 and 34 may have substantially identical layouts. The feed 24 is a splitter, with an input or output 43 in the form of a single electrical signal, and branching feeds that distribute that signal to multiple locations (connection points) equally circumferentially spread about the annular waveguide structure 22 (FIG. 1). The feed 24 branches out to 256 connections to the annular waveguide, with connections being separated approximately half a wavelength apart from one another, based on the smallest wavelength in the range of signal wavelengths that the joint 10 is intended to pass. For example, the rotary joint 10 may be configured to pass electrical signals having a frequency centered around 20-24 GHz, although the electrical connection may be configured to pass signals of many other frequencies and wavelengths. More broadly, the signals may be in the Ka band, which has been defined as the frequencies of 26.5-40 GHz, with wavelengths from slightly over one centimeter down to 0.75 centimeters. The feeds 24 and 34 may be printed circuit boards or other suitable electrical splitter structures. The feeds 24 and 34 may have a different number of connections, and/or a different spacing of connections, than those in the illustrated embodiment.

The half-wavelength spacing in the illustrated embodiment is not intended to be limiting. Other suitable wavelengths may be used, such as a spacing larger than the half-wavelength spacing of the illustrated embodiment.

The branching of the feeds 24 and 34 means that the size of the individual cells (the distance between adjacent connections, the finest branches of the feeds 24 and 34) may be small compared to the circumference of the annular waveguide structures 22 and 32. This means that the curvature may have negligible effects, and that the annular waveguide structures behave to a good approximation as infinite parallel-plate waveguides.

Figure 3:
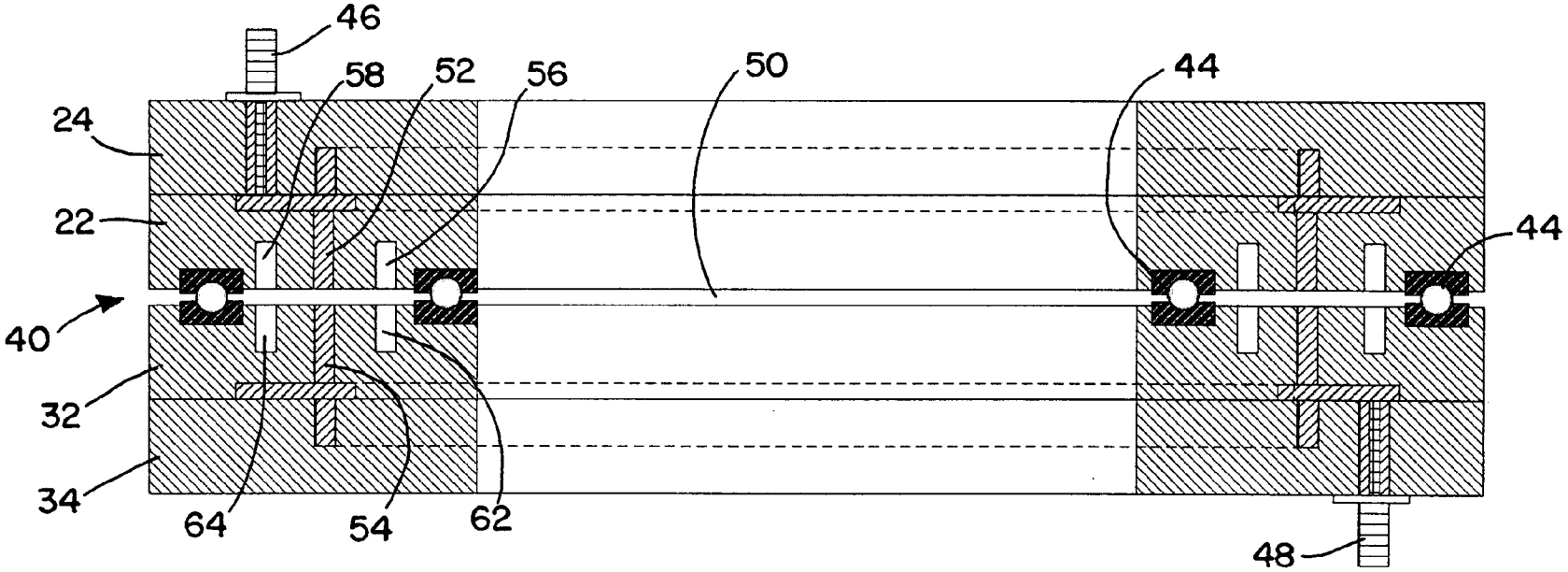
FIG. 3 is a side cross-sectional view of the electrical connection of the rotary joint of FIG. 1.

Referring now in addition to FIG. 3, additional details of the electrical connection 40 are shown. One or more bearings 44 bridge the axial gap 50 between the waveguide structures 22 and 32, allowing relative rotation between the waveguides 22 and 32. The bearings 44 may be suitable ball bearings, and may be made of any of a variety of suitable materials. There may be some electrical conduction through the bearings 44, but any electrical conduction is not the primary way that electrical signals are passed between the waveguide structures.

Electrical connectors 46 and 48 may be parts of the feeds 24 and 34, respectively, to route electrical signals into and out of the feeds 24 and 34. The electrical connectors 46 and 48 may be coaxial connectors or other suitable kinds of electrical connectors.

The signals travel between the waveguide structures 22 and 32 along respective annular gaps 52 and 54 in the waveguide structures 22 and 32. The waveguide structure 22 has annular notches 56 and 58, and the waveguide structure 32 has annular notches 62 and 64. The notches 56, 58, 62, and 64 extend outward from the axial gap 50 between the waveguide structures 22 and 32, into part of the depth of the material of the waveguide structures 22 and 32. The notches 56 and 58 are on opposite respective sides of the annular gap 52, with the notch 56 being an inner notch and the notch 58 being an outer notch. The notches 62 and 64 are similarly on opposite respective sides of the annular gap 54. The notches 56, 58, 62, and 64 act as choke points or radio frequency (RF) chokes to prevent leakage of the signal radially inward or outward from the axial gap 50. The RF chokes also may operate to prevent power leakage out of or into the electrical connection 40, and/or may aid in complying with requirements related to electromagnetic compatibility (EMC) and/or electromagnetic interference (EMI).

The waveguide structures 22 and 32 may be made of a suitable electrically conductive material, for example aluminum. Alternatively the waveguide structures may be made of an electrically-nonconductive material that is coated by an electrical conductor.

Figure 4:
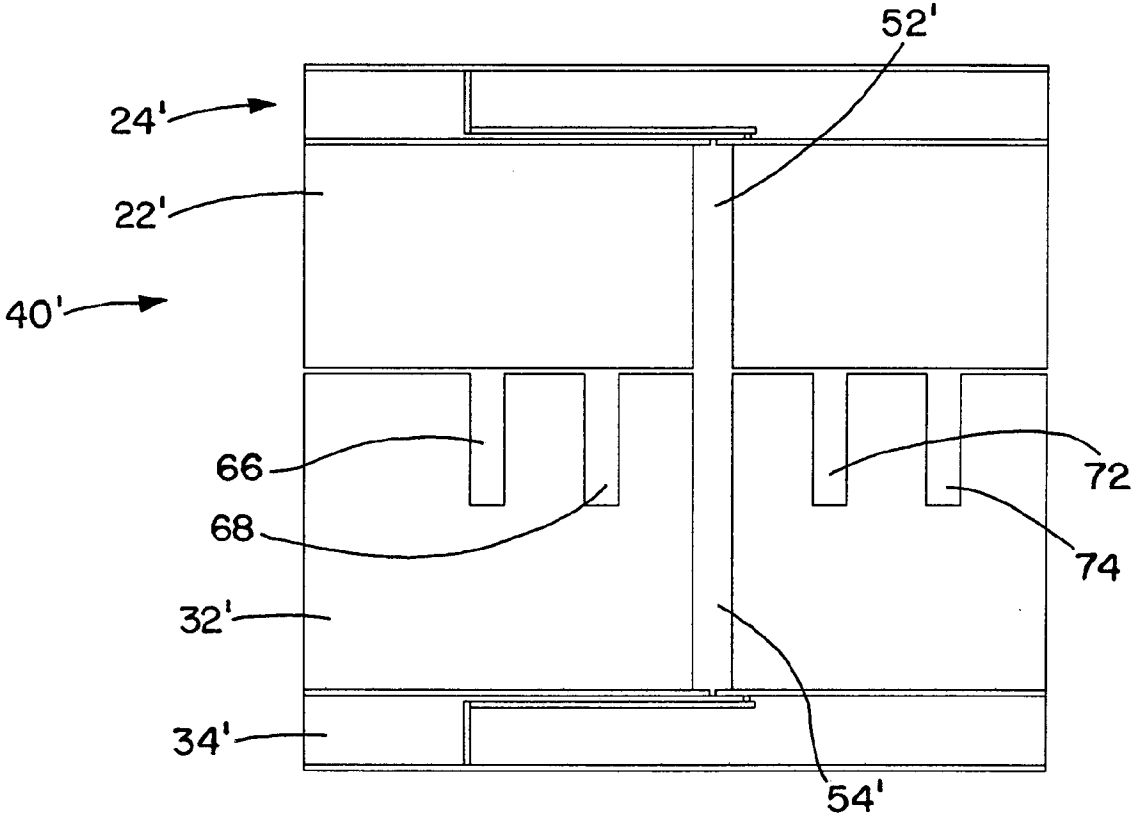
FIG. 4 is a side cross-sectional view of part of an electrical connection of an alternate embodiment rotary joint.

FIG. 4 shows an alternate configuration, with dual inner notches 66 and 68, and dual outer notches 72 and 74, in a single waveguide structure 32', on opposite sides of an annular gap 54'. Features of the waveguide structures 22' and 32' may be combined with those of the waveguide structures 22 and 32 (FIG. 3). The other waveguide structure 22' has no notches around its annular gap 52'. As an example of the dimensions involved, the waveguide structure 22' may have a height of 6.35 mm (250 mils), and the waveguide structure 32' may have a height of 8.9 mm (350 mils). The annular gaps 52' and 54' may have a width of 1.27 mm (50 mils). The notches 66, 68, 72, and 74 may each have a width of 1.27 mm (50 mils), and a depth of 1.9 mm (150 mils). The notches 66 and 68 may be separated by 1.9 mm (150 mils), and the notches 72 and 74 may be separated by the same distance. The axial gap may be about 0.076 mm (3 mils). The feeds 24' 24 and 34' 34 may have a thickness of 2.1 mm (81 mils), which is about one-quarter of the wavelength of electrical signals expected to be passed using the electrical connection 40'. As described in greater detail below, such a thickness for the feeds 24' and 34' helps provide better signal strength by reflecting the signal in the feeds 24' and 34' (incoming or outgoing) roughly in phase, to improve the signal strength. The notches 66, 68, 72, and 74 also may be sized in relation to the wavelength of electrical circuits to be passed in the electrical connection 40'. The dimensions given above are those for a single specific embodiment. A wide variety of other dimensions are possible in other embodiments.

Figure 5:
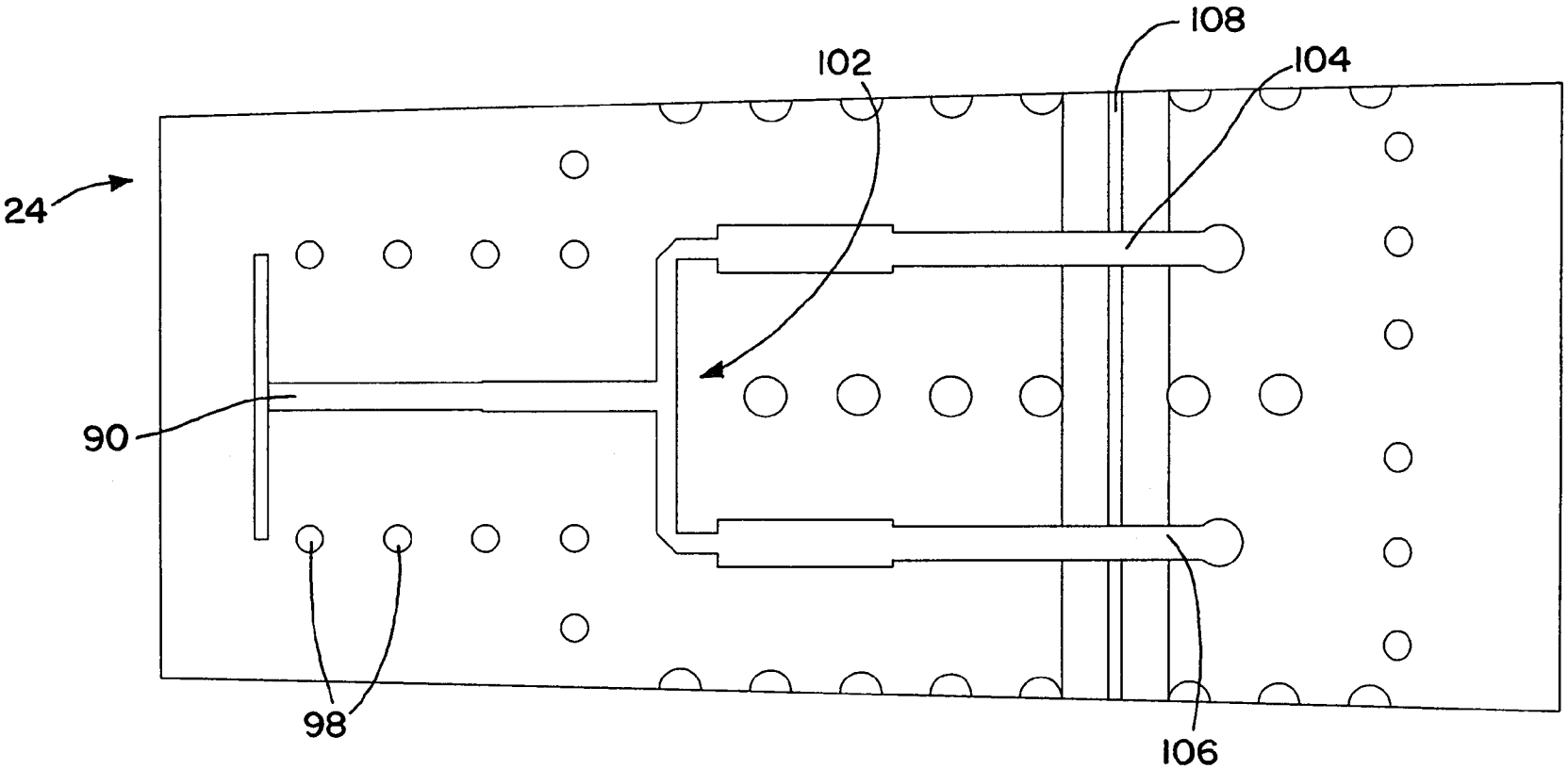
FIG. 5 is a plan view showing details of a feed of the rotary joint of FIG. 1.
Figure 6:
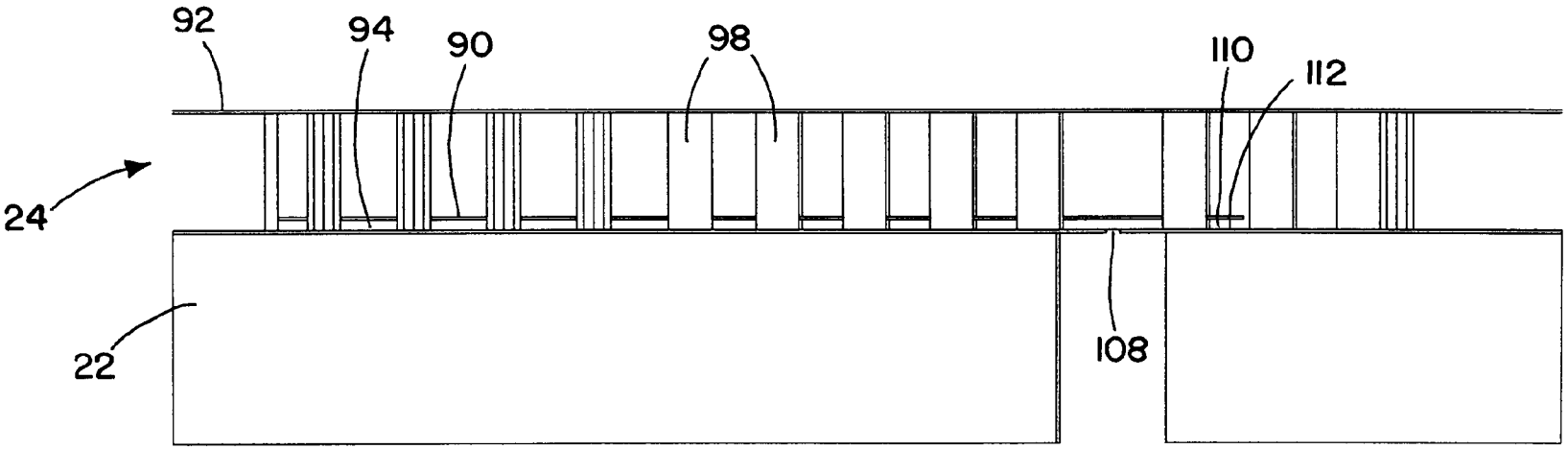
FIG. 6 is a side view of the feed of FIG. 5.

With reference now in addition to FIGS. 5 and 6, the feed structure 24 of the waveguide structure 22 (FIG. 6) includes a series of striplines or microstrip lines, such as a stripline 90, that are located between a pair of ground planes 92 and 94 (FIG. 6) on opposite top and bottom sides of the feed structure 24. The striplines may be located within a printed circuit board, with no additional cavities (such as machined cavities) needed within the waveguide structure. The striplines in the illustrated embodiment are one example of a variety of transmission lines that may be used. The ground planes 92 and 94 are connected with one another through a series of conductive ground vias 98. The stripline 90 may have a configuration as shown in FIGS. 5 and 6, with an impedance transformation provided by segments of conductive material with various suitable widths, on both sides of a final split 102 in the stripline 90, into fingers 104 and 106 (FIG. 5). The cell size, the distance between the adjacent fingers, may be about half a wavelength, for example 3.5 mm (138 mils). The stripline 90 extends across a long slot 108 in the bottom ground plane 94. Conductive signal vias 110 (FIG. 6) may be used to electrically couple the stripline 90 to the bottom ground plane 94, with the signal vias 110 making connection at connection points 112 (FIG. 6) for incoming or outgoing signals. The long slot 108 may have a width of 0.18 mm (7 mils), to give one example value. The configuration of the feed 24 produces a TEM wave in the long slot 108. It is this TEM wave that propagates in an axial direction to carry the signal from across the rotary joint 10. The ground plane 92 reflects and reinforces the TEM wave produced in the slot 108. The reinforcing may includes reinforcing in phase, with the ground plane 92 one-quarter wavelength of the electrical signal away from the ground-plane 90.

The stripline 90 may be closer to the bottom ground plane 94 than to the top ground plane 92. In one example embodiment, the stripline 90 may be 0.13 mm (5.1 mils) away from the bottom ground plane 94, and may be about 1.9 mm (75 mils) away from the top ground plane 92. These distances are only examples, and many other distances are possible.

The feeds 24 and 34 do not remain aligned as the rotary joint parts 12 and 14 rotate relative to one another. There may be a misalignment of cells of the feeds 24 and 34 and the annular waveguide structures 22 and 32 by as much as half a cell width (a quarter wavelength) of misalignment. However, this misalignment has been found to have no appreciable effect on the ability of the electrical connection 40 to accurately pass electrical signals.

In one embodiment, the electrical connection 40 (FIG. 1) passes electrical signals with a loss of 20-30 dB. Signal strength may be boosted by use of suitable amplifiers upstream and/or downstream of the rotary joint 10 (FIG. 1), if needed or desired.

Figure 7:
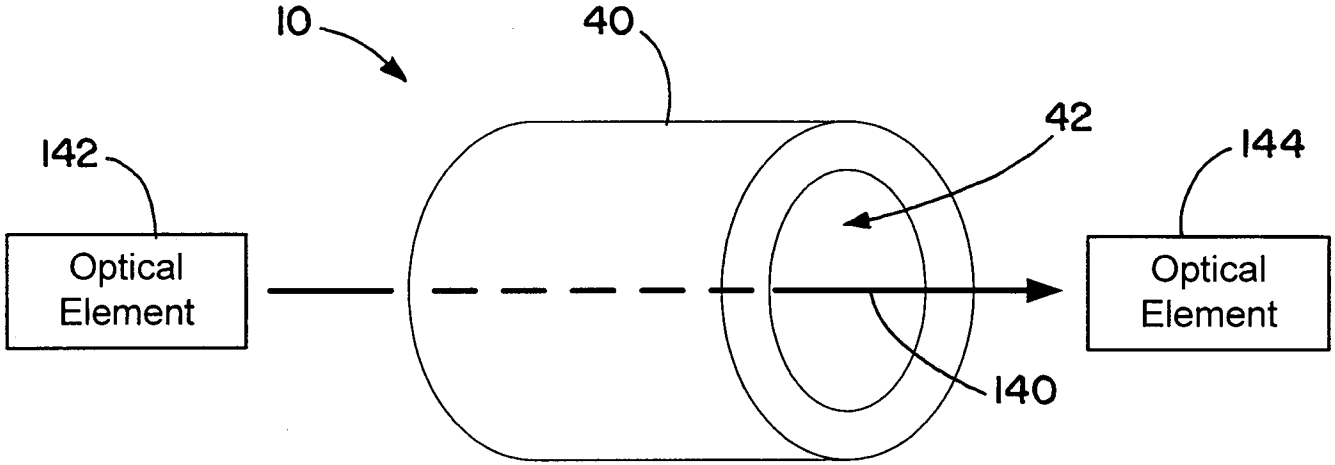
FIG. 7 is a partially schematic view showing passage of an optical signal through a core of the annular electrical connection of the rotary joint of FIG. 1.

With reference now in addition to FIG. 7, one advantage that the rotary joint 10 has is that the central core region 42 surrounded by the electrical connection 40 may be used for other purposes, for example for transmitting optical signals 140 from an optical element (transmitter) 142 on one side of the rotary joint 10 to an optical element (receiver) 144 on the other side of the rotary joint 10. The optical transmitter 142 and the optical receiver 144 may be any of a variety of suitable optical elements for transmitting, receiving, and/or otherwise manipulating optical signals sent in either or both directions through the core region 42. The optical transmitter 142 and/or the optical receiver 144 may be directly connected to or otherwise part of the rotary joint 10, or alternatively may be separate from the rotary joint 10. The passage of optical signals through the core region 42 is only one example of use of the core region 42 for purposes other than passage of electrical signals. Many other uses of the core region 42 are possible, for example with another electrical connection made in the core region 42. For example, the core region 42 may alternatively be used for hydraulic power transfer, for cooling air transfer, for RF power transfer, for passage of signals for examining a specimen (as in a scanner, such as a computed tomography (CT) scanner or a magnetic resonate imaging (MRI) scanner), or for passage of mechanical devices, such as in a drill rig, to list just a few examples of alternative uses.

The rotary joint 10 may be used to pass multiple signals simultaneously. Multiple signals may be collected on either side of the rotary joint, and multiplexed into a single serial digital data stream. An RF carrier signal may be modulated with the serial digital data stream, to be transported through the rotary joint 10 and through other similar rotary joints that are connected in series with the rotary joint 10. Multiple transmitters and receivers may share the same RF conduit through any combination of time, frequency, and/or code division multiplexing.

Figure 8:
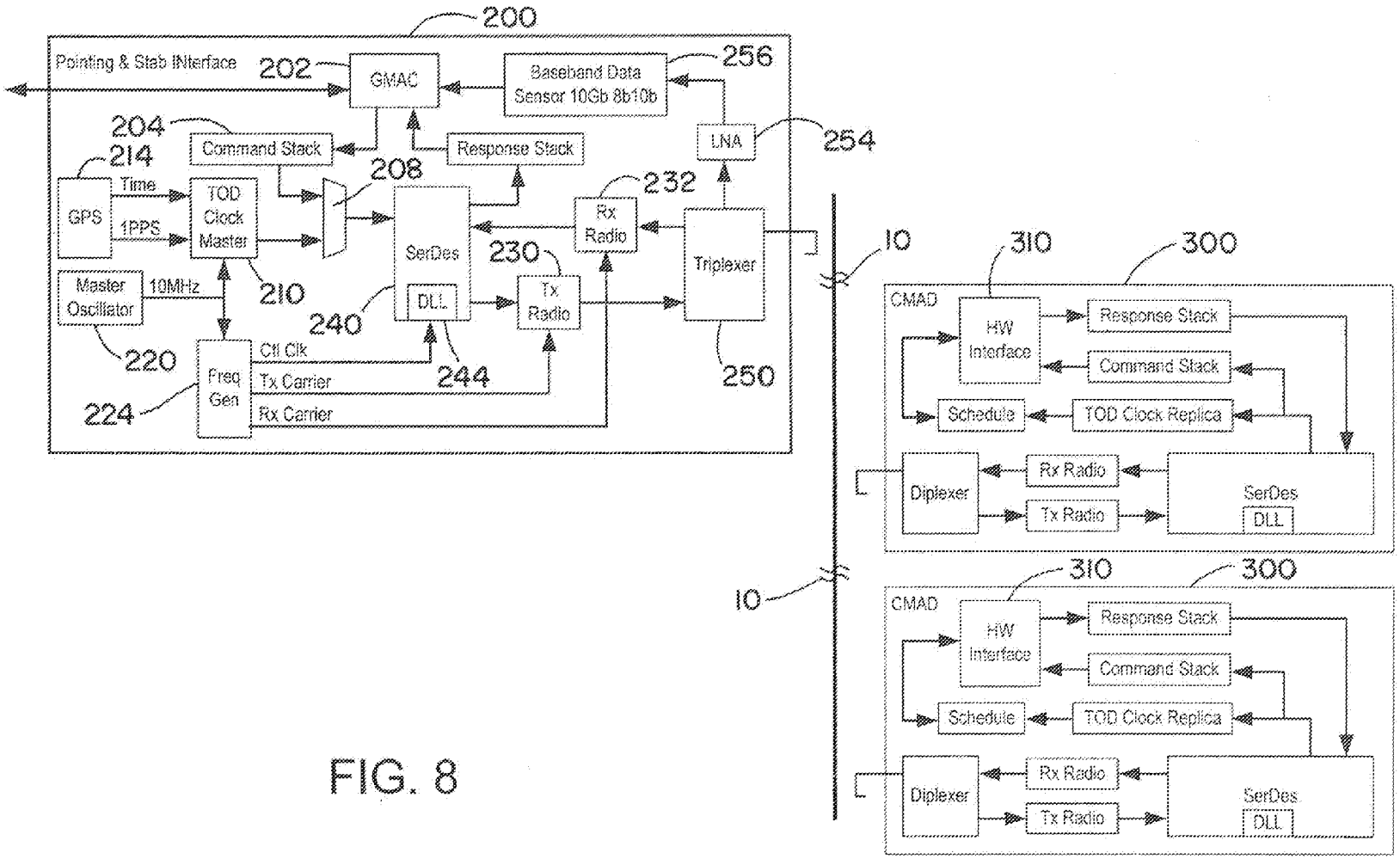
FIG. 8 is a block diagram illustrating a multiplexing interface usable to transmit multiple signals simultaneously across one or more rotary joints.

With reference to FIG. 8, the multiplexing and demultiplexing may be accomplished in an interface 200. The various parts of the interface 200 that are described below may be embodied in hardware and/or software, as appropriate. The interface 200 may include a gigabit media access controller (GMAC) 202 that is able configure and interpret signals for transmission across the rotary joint 10. The GMAC 202 outputs to a command stack 204, which in turn sends signals as appropriate to a multiplexer 208. Multiple signals may be multiplexed at the multiplexer 208, which receives input from a time of day (TOD) clock master 210 that in turn receives a pulse per second (PPS) signal from a global positioning system (GPS) 214. The GPS 214 also provides the pulse signal to a master oscillator 220, which provides a 10 MHz (or other suitable frequency) signal to both the TOD clock master 210 and a frequency generator 224.

The frequency generator 224 generates a transmit carrier signal (Tx carrier) and a receive carrier signal (Rx carrier), used in transmitting and receiving RF signals at a transmitter 230 and a receiver 232. The carrier signals may be at 22 GHz and 24 GHz, to give non-limiting example values.

Output from the multiplexer 208 is passed through a serializer/deserializer (SerDes) 240, which has a data link layer (DLL) 244. The serializer/deserializer 240 also receives input from the receiver 232, and passes data to a response stack 246, which is coupled to the GMAC 202 at the downstream end of the response stack 246.

The transmitter 230 and the receiver 232 are coupled to a triplexer 250, which is configured to send signals to and receive signals from the rotary joint 10. The triplexer 250 also sends received signals through a low noise amplifier (LNA) 254, to provide baseband sensor data 256 to the GMAC 202.

As noted above, the interface 200 may be used to provide multiplexed signals using any suitable combination of time, frequency, and/or code division multiplexing. Signals can be passed through multiple of the rotary joints 10, without a need to demultiplex the signals after each of the rotary joints 10. The multiplexed signal may be interacted with along the way, for example with control multiplexer and add/drop (CMAD) interfaces 300, many details of which are shown in FIG. 8 but are not described herein because such details are conventional in the art and thus are not necessary to understand the invention. The interfaces 300 use components similar to those of the interface 200 to transmit and receive the multiplexed signals passing along and through some or all of the rotary joints 10. The CMAD interfaces 300 may include hardware interfaces 310 for interacting with hardware that may receive signals from the multiplexed signal, and/or that may send signals to be transmitted as part of the multiplexed signal.

The rotary joint 10 provides many advantages over prior rotary electrical connections. The electrical connection is contactless, which means that there is no wear and tear from a need to have electrical contact maintained as the parts are rotated relative to one another. In addition the rotary joint 10 can operate with a full 360-degree rotation, which cannot be achieved by coaxial cables, for example. Further, as noted earlier, by keeping the central core region open, sending of optical signals can be accomplished along the axis of rotation. Near-constant phase and amplitude performance can be maintained independent of rotation.

The rotary joint 10 may be used in any of a variety of situations. One example of use is to send signals for rotating motors for positioning an optical sensor, such as in a pod on an airplane. Many other uses for the rotary joint 10 are possible.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A rotary joint comprising:

a first part; and a second part that rotates relative to the first part about an axis of rotation;

wherein the first part has a first electrical connection annular portion;

wherein the second part has a second electrical connection annular portion;

wherein the first and second electrical connection annular portions make contactless electrical connection with one another;

wherein the electrical connection annular portions together define and surround a core region, wherein an electrical connection between the first and second electrical connection annular portions is not made through the core region;

wherein the core region includes the axis of rotation;

wherein the first electrical connection annular portion includes:

a first annular waveguide structure; and a first feed electrically coupled to the first annular waveguide structure; and wherein the second electrical connection annular portion includes:

a second annular waveguide structure; and a second feed electrically coupled to the second annular waveguide structure;

wherein the first and second annular waveguide structures define respective first and second annular gaps within the corresponding annular waveguide structures, and an axial gap therebetween;

wherein first feed is operatively coupled to the first annular waveguide structure to produce a transverse electromagnetic (TEM) wave that propagates from the annular gap of the first annular waveguide structure, across the axial gap, to the annular gap of the second annular waveguide structure wherein the first and second feeds each include transmission lines that are between a pair of ground planes;

wherein the transmission lines include fingers that span a gap in one of the pair of ground planes; and wherein the TEM wave is produced in the gap in the one of the pair of ground planes.

2. The rotary joint of claim 1, further comprising a bearing between the first part and the second part.

3. The rotary joint of claim 1, wherein the first feed is substantially identical to the second feed.

4. The rotary joint of claim 1, in combination with an optical signal transmission that passes optical signals through the core.

5. The rotary joint of claim 1, wherein the first and second feeds are splitters that provide electrical connection between a single input or output and connection points, where the first and second feeds are operatively coupled to the respective annular waveguide structures.

6. The rotary joint of claim 5, wherein the connection points are substantially equally circumferentially spread about a circumference of the feed.

7. The rotary joint of claim 1, wherein the first annular waveguide structure is substantially identical to the second annular waveguide structure.

8. The rotary joint of claim 1, wherein the other of the pair of ground planes reflects and reinforces the TEM wave produced in the gap in the one of the pair of ground planes.

9. The rotary joint of claim 1, wherein the first and second feeds include printed circuit boards.

10. The rotary joint of claim 1, wherein one of the first and second annular waveguide structures includes at least two annular notches, with at least one of the at least two annular notches radially inside the annular gap of the one of the first and second annular waveguide structures, and with at least another of the at least two annular notches radially outside of the annular gap of the one of the first and second annular waveguide structures.

11. The rotary joint of claim 10, wherein the at least two annular notches function as an RF choke, providing containment and/or isolation to electrical signals passing between the annular gaps of the first and second annular waveguide structures.

12. A method of passing an electrical signal across a rotary joint, the method comprising:

inputting an incoming electrical signal into a first feed that splits the signal;

generating in the first feed a transverse electromagnetic (TEM) wave, wherein the TEM wave propagates in an axial direction through a first annular waveguide structure that is coupled to the first feed;

passing the TEM wave across an axial gap, from the first annular waveguide structure to a second annular waveguide structure that is able to rotate relative to the first annular waveguide structure about an axis of rotation of the rotary joint that does not pass through the annular waveguide structures; and generating an outgoing electrical signal from the TEM wave in a second feed that is operatively coupled to the second annular waveguide structure;

wherein the generating the TEM wave includes generating the TEM wave in an annular gap in a first ground plane of the first feed;

wherein the generating includes reinforcing the TEM wave using reflection off of a second ground plane of the first feed; and wherein the reinforcing includes reinforcing in phase, with the second ground plane one-quarter wavelength of the electrical signal away from the first ground plane.

13. The method of claim 12, wherein the generating includes generating from connection points of the first feed that are spaced one-half wavelength apart from one another about a circumference of the first feed.

14. The method of claim 12, wherein the first feed is substantially identical to the second feed; and wherein the first annular waveguide structure is substantially identical to the second annular waveguide structure.

* * * * *